US007975769B2

(12) United States Patent
Pollack et al.

(10) Patent No.: US 7,975,769 B2
(45) Date of Patent: Jul. 12, 2011

(54) FIELD DEVELOPMENT WITH CENTRALISED POWER GENERATION UNIT

(75) Inventors: Jack Pollack, Houston, TX (US); Hein Wille, Eze Village (FR)

(73) Assignee: Single Buoy Moorings Inc., Marly (CH)

( * ) Notice: Subject to any disclaimer, the term of this patent is extended or adjusted under 35 U.S.C. 154(b) by 1093 days.

(21) Appl. No.: 10/593,895

(22) PCT Filed: Oct. 13, 2004

(86) PCT No.: PCT/EP2004/011613

§ 371 (c)(1),
(2), (4) Date: Nov. 21, 2006

(87) PCT Pub. No.: WO2005/090152

PCT Pub. Date: Sep. 29, 2005

(65) Prior Publication Data

US 2008/0223582 A1 Sep. 18, 2008

(30) Foreign Application Priority Data

Mar. 23, 2004 (EP) ..... 04075946

(51) Int. Cl.
*E21B 29/12* (2006.01)
*B65B 3/00* (2006.01)

(52) U.S. Cl. ..... 166/350; 166/355; 166/344; 114/230.1; 141/387; 441/5; 405/224.3

(58) Field of Classification Search ..... 166/366, 166/367, 355, 352, 354, 345, 344; 405/169, 405/195, 224.2–224.4; 441/5, 3, 4; 114/230.1, 114/230.12; 141/387
See application file for complete search history.

(56) References Cited

U.S. PATENT DOCUMENTS

| | | | | | |
|---|---|---|---|---|---|
| 3,021,864 | A | * | 2/1962 | Young | 137/236.1 |
| 3,173,271 | A | * | 3/1965 | Wittgenstein | 405/172 |
| 3,313,345 | A | * | 4/1967 | Fischer | 166/355 |
| 3,590,407 | A | * | 7/1971 | Bratianu et al. | 114/256 |
| 3,984,059 | A | * | 10/1976 | Davies | 141/387 |
| 4,096,705 | A | * | 6/1978 | Lamy | 405/170 |
| 4,263,004 | A | * | 4/1981 | Joubert et al. | 405/172 |
| 4,339,002 | A | * | 7/1982 | Gibbs | 166/355 |

(Continued)

FOREIGN PATENT DOCUMENTS

GB 2 390 351 1/2004

(Continued)

*Primary Examiner* — Thomas A Beach
(74) *Attorney, Agent, or Firm* — Young & Thompson

(57) ABSTRACT

The invention relates to a hydrocarbon exploration system, comprising a first vessel (1) having a turret (3) around which the vessel can weathervane, the turret being moored to the sea bed (4), and a second vessel (7) connected with at least one riser (12) to a subsea well (5), the first vessel (1) being connected to the second vessel via a fluid transfer duct (20) comprising a first end section (23) attached to the turret of the first vessel (1), a substantially horizontal mid section (24), and a second end section (22) attached at or near the second vessel (7), the second vessel (7) weighing between 2,000 and 15,000 ton its base being attached to the sea bed via taut tendons (9), the weight exerted by the fluid transfer duct (20) on the second vessel being below 1,000 ton, a power generator being situated on the first vessel (1), power being transferred from the power generator via an electrical swivel on the first vessel.

7 Claims, 6 Drawing Sheets

U.S. PATENT DOCUMENTS

Figure 1:
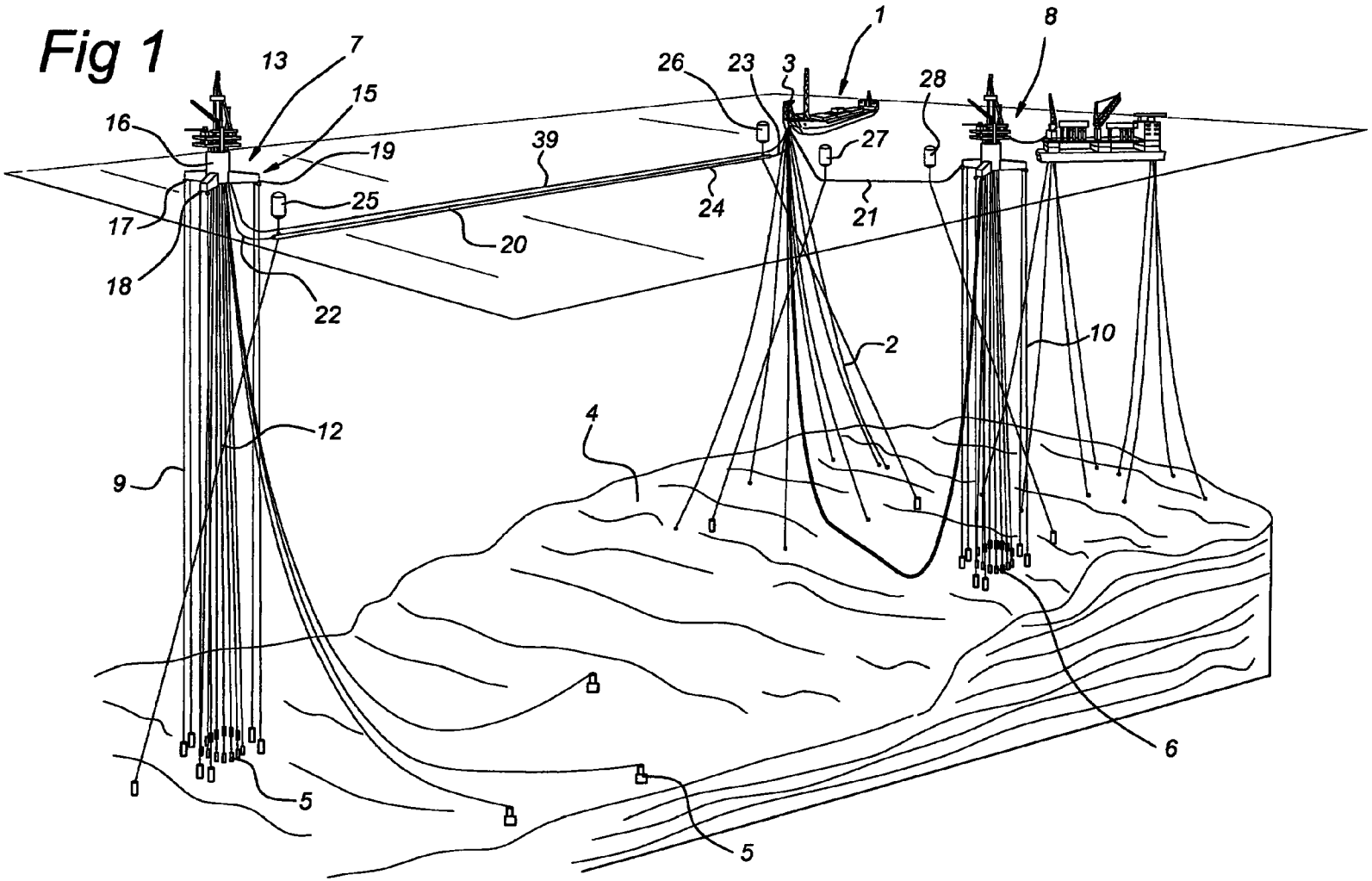

| | | | | |
|---|---|---|---|---|
| 4,462,717 | A * | 7/1984 | Falcimaigne | 405/224.3 |
| 4,530,302 | A * | 7/1985 | Pedersen | 114/230.15 |
| 4,753,185 | A * | 6/1988 | Salusbury-Hughes | 114/61.13 |
| 5,275,510 | A * | 1/1994 | de Baan et al. | 405/171 |
| 5,480,264 | A | 1/1996 | Hunter | |
| 5,542,783 | A * | 8/1996 | Pollack | 405/223.1 |
| 5,575,592 | A * | 11/1996 | Pollack | 405/223.1 |
| 5,582,252 | A * | 12/1996 | Richmond et al. | 166/352 |
| 5,957,074 | A * | 9/1999 | de Baan et al. | 114/230.12 |
| 6,003,603 | A * | 12/1999 | Breivik et al. | 166/357 |
| 6,021,848 | A * | 2/2000 | Breivik et al. | 166/344 |
| 6,206,742 | B1 * | 3/2001 | Bull et al. | 441/1 |
| 6,250,244 | B1 * | 6/2001 | Dubar et al. | 114/264 |
| 6,394,154 | B1 | 5/2002 | Pollack | |
| 6,558,215 | B1 * | 5/2003 | Boatman | 441/5 |
| 6,595,725 | B1 * | 7/2003 | Shotbolt | 405/224.2 |
| 6,893,486 | B2 * | 5/2005 | Sanderford et al. | 95/243 |
| 6,973,948 | B2 * | 12/2005 | Pollack et al. | 141/387 |
| 6,983,712 | B2 * | 1/2006 | Cottrell et al. | 114/230.15 |
| 7,040,841 | B2 * | 5/2006 | Kelm et al. | 405/224.2 |
| 7,119,460 | B2 * | 10/2006 | Poldervaart et al. | 307/149 |
| 7,137,822 | B1 * | 11/2006 | Longmire et al. | 439/24 |
| 7,174,931 | B2 * | 2/2007 | Espinasse | 141/387 |
| 7,434,624 | B2 * | 10/2008 | Wilson | 166/368 |
| 7,591,316 | B2 * | 9/2009 | Hatton | 166/355 |
| 7,677,837 | B2 * | 3/2010 | Pionetti et al. | 405/171 |
| 2003/0091396 | A1 | 5/2003 | Barras et al. | 405/158 |
| 2003/0226373 | A1 * | 12/2003 | Prible et al. | 62/612 |
| 2004/0238176 | A1 * | 12/2004 | Appleford et al. | 166/353 |
| 2005/0254901 | A1 * | 11/2005 | Lovie | 405/169 |
| 2006/0004593 | A1 * | 1/2006 | Seat et al. | 705/1 |
| 2006/0283590 | A1 * | 12/2006 | Poldervaart et al. | 166/265 |
| 2008/0267716 | A1 * | 10/2008 | D'Souza et al. | 405/203 |

FOREIGN PATENT DOCUMENTS

| | | |
|---|---|---|
| WO | WO 04/000638 | 12/2003 |

* cited by examiner

FIELD DEVELOPMENT WITH CENTRALISED POWER GENERATION UNIT

The invention relates to a hydrocarbon exploration system, comprising a first vessel having a turret around which the vessel can weathervane, the turret being moored to the sea bed, and a second vessel connected with at least one riser to a subsea well, the first vessel being connected to the second vessel via a fluid transfer duct comprising a first end section attached to the turret of the first vessel, a substantially horizontal mid section, and a second end section attached to the second vessel, a buoyancy member being attached at or near the second end section.

Such a system is known from Lovik, Forsberg and Nygard, Submerged initial tensioned buoyant line, DOT International Conference, 2001, New Orleans, La., USA In this publication a submerged oil transfer pipeline, extending between an FPSO and a semi submersible platform or a SPAR buoy is disclosed. The transfer pipeline is at each end of the horizontal pipe bundle provided with buoyant pipeline end terminals, which are attached to the sea bed via a respective inclined anchor line to form a v-shaped mooring configuration. Hereby a horizontal axial tension is exerted on the pipeline preventing bending due to cross currents. The semi-submersible platform is relatively stable, and can carry a relatively large weight of the transfer duct. Furthermore, processing equipment and power generators may be situated on the semi-submersible.

From Pollack, "The Fluid Transfer System between a DCU and an FPSO at 20-30 km Distance", (14$^{th}$ DOT International Conference and Exhibition, 13-15 Nov. 2002, New Orleans, and from U.S. Pat. No. 6,394,154 in the name of the applicant, a mid water transfer pipe is known that is connected to a dry tree completion unit and an FPSO, extending over a distance of 30 km, and being tensioned in an axial direction. At the end parts of the horizontal duct section, clump weights are suspended exerting a downwards force on the horizontal duct section. A support chain extends from each vessel, at an angle with the vertical, to the end sections of the horizontal duct section, such that as a resultant force an axial tensioning force is exerted counteracting hogging and sagging of the transfer duct. The counterweights exert an additional weight on the dry tree completion unit, which maybe tilted from its equilibrium position which may adversely affect the dynamic response and stability.

It is an object of the present invention to provide a hydrocarbon processing system, which utilises a relatively light floating structure connected to a subsea well via a production riser and connected to the transfer pipe. It is another object to provide an processing system which can be used in deep water and which can provide production stations at multiple well positions at remote locations.

Hereto the hydrocarbon exploration system according to the invention is characterised in that the second vessel has a hull weight of between 2,000 and 15,000 ton, and comprises an upper structure and a submerged base attached to the sea bed via taut tendons, the weight exerted by the fluid transfer duct on the second vessel being below 1,000 ton, a power generator being situated on the first vessel, power being transferred from the power generator via an electrical swivel on the first vessel, to a power supply cable, the power supply cable extending along the fluid transfer duct from the first vessel to the second vessel, and being supported on the fluid transfer duct.

The light weight second vessel, can be a small Tensioned Leg Platform (TLP) as disclosed in patent publications U.S. Pat. No. 5,575,592 and U.S. Pat. No. 5,964,550 which is stably anchored above a hydrocarbon well in deep water (water depths of 1000 meters or more), via the taut tendons. The tendons may be attached to radial arms extending from a central part of the submerged base. The weathervaning first vessel, which can be an FPSO, receives the produced hydrocarbons via the horizontal transfer duct, which is suspended between the vessels and which may extend along a distance of between 3 and 30 km, at a depth of between 30 and 300 meter below sea level. Because of the buoyancy provided at the end part of the horizontal fluid transfer duct which is attached to the second vessel, the forces exerted on the light weight second vessel are low and do not affect its orientation and mooring stability which is imparted by the taut tendons.

A particular stable mooring configuration is obtained by the use of the at least three transverse mooring arms to which the tendons are attached, leaving sufficient space at the central part for receiving the product risers or to create sufficient space for the jumper hose or fluid pipe which are leading from the deck of the second vessel towards the horizontal fluid transfer duct.

Furthermore, the weight and complexity of the second vessel are maintained relatively low by generating the power that is required on the second vessel for the operation of pumps, valves and optionally any other equipment like workover equipment, first stage separation, gas lift equipment, etc., situated on the very much larger first vessel, which may have a hull weight of at least 150,000 ton. The power cable is supported on the neutral buoyant fluid transfer duct, for instance on an internal or external frame, such that its weight does not act on the second vessel. Transfer of power from the weathervaning FPSO can take place via a high voltage swivel, such as described in European patent application no EP 04075946.6, filed on 23 Mar. 2004.

The embodiment in which the horizontal fluid transfer duct is provided with buoyancy at both ends has the advantage that it can be (pre-) installed separately from the FPSO or the second vessel, as it is independently floating. This is also advantageous when one of these elements needs to be removed temporarily for maintenance or change-out purposes. As all elements of this system are independently buoyant, dynamic excursions of the floaters are decoupled from the horizontal fluid transfer duct which results in less fatigue for the horizontal fluid transfer system.

In one embodiment of the present invention, at least one further vessel, of similar type as the second vessel, is attached to the first vessel via a respective fluid transfer duct in a similar manner as the second vessel. By use of the relatively light-weight and simple second vessels, more hydrocarbon wells which are situated at a relatively large distances from each other, can be connected to a single main storage and/or processing vessel, at relatively low costs.

Another advantage of using the low cost, low weight second vessels is that with relatively low investments, a field can be gradually developed were the first placed second vessel will give an early return on investment and more second vessel types being added when the field is developed. Depending on the performance of the field after a second vessel is installed, it can be decided to install more second vessels (satellite production units) or not. Another advantage is that a second vessel can be easily disconnected and installed near another well in the same field, if the first well is not performing or dried up.

In one embodiment, the transfer duct is tensioned by anchor lines extending to the sea bed at an angle to the vertical, to result, in combination with the upwards force exerted by the buoyancy at the second end of the transfer duct, in an axial tension on the transfer duct. In another embodiment the horizontal transfer duct extends along a curved trajectory, such as a W-shaped path, to be elongatable in its length direction. Buoyancy members are attached along the length of the transfer duct. As a further alternative, the hydrocarbon transfer duct may be provided, near the first vessel with a clump weight and inclined suspension member to result in an axial tensioning force, in the manner as described in U.S. Pat. No. 6,395,152.

In one embodiment of the present invention, the second vessel has no large hydrocarbon storage facilities an a hull weight of between 2,000 and 15,000 ton, and comprises an upper structure and a submerged base, a power generator being situated on the first vessel, a power supply cable extending from the first vessel to the second vessel, the power supply cable being attached to the power generator via an electrical swivel on the turret of the first vessel.

By generating the power on the first vessel, the pumps, valves and other electrical equipment on the fist vessel can be operated, while maintaining the weight and therefore the costs of the second vessel, which may comprise a DCU of the SPAR or TLP-type and described in OTC 11927, Dry Tree Completion Units for West Africa Field Development, Houston, Tex. 1-4 May 2000, which is incorporated herein by reference. The light weight, low cost lay-out of the second vessel allows incremental field development while generating electrical power from a single power generator on the FPSO. The power supply cable, who may carry a voltage of between 1 and 50 kV at a current of between 10 and 500 A, (e.g. 33 kV at 395 A) and the fluid transfer duct may extend along the sea bed, but are preferably suspended between the two vessels in an axially tensioned configuration.

To the end parts of the horizontal transfer ducts, a tensioning cable may be attached with one end, the other end being attached to the sea bed, at an angle to the vertical. A buoyancy elementor a tensioning cable attached to the first or second vessel, is attached to the end part for supporting the end part from the first or second vessel, and resulting in an axial tension being exerted on the horizontal duct section.

Figure 2:
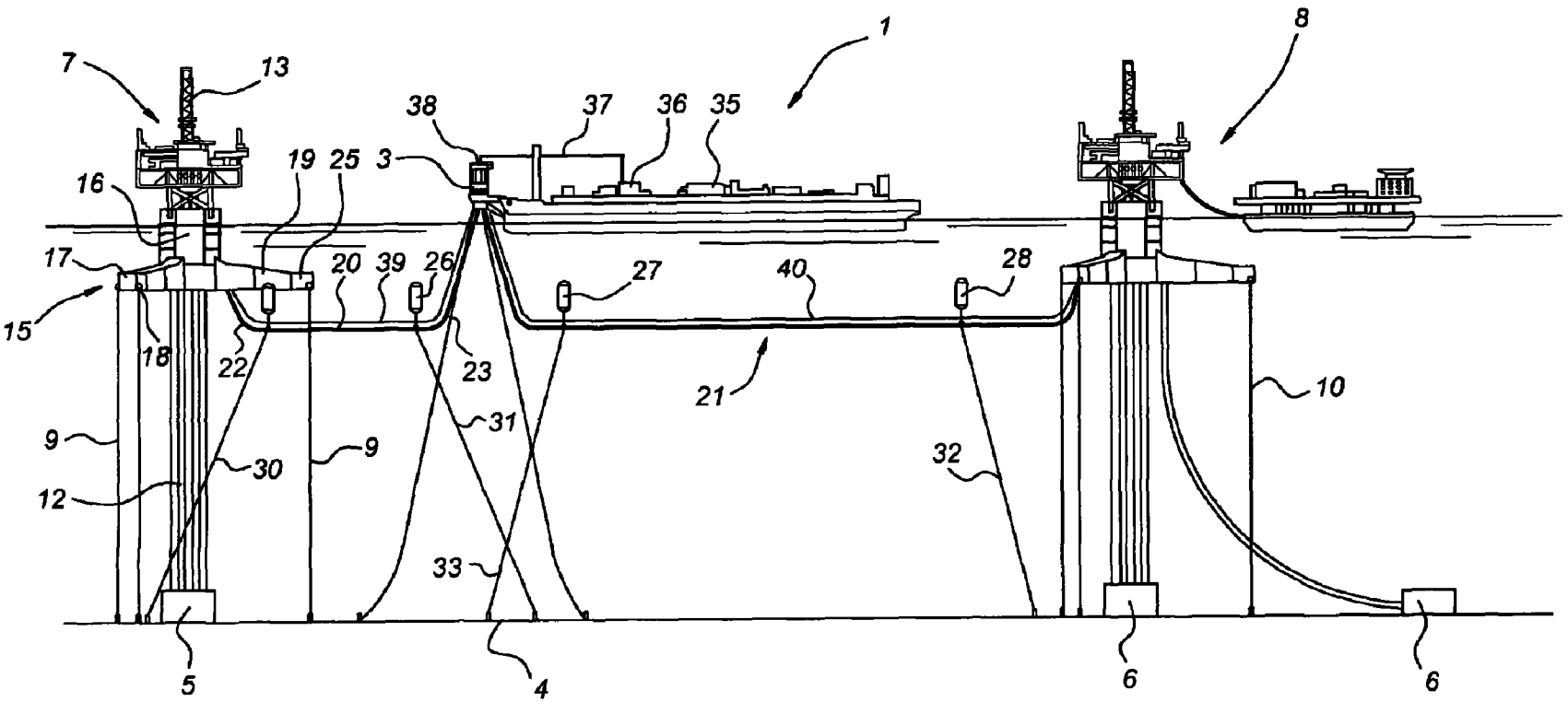
Figure 3:
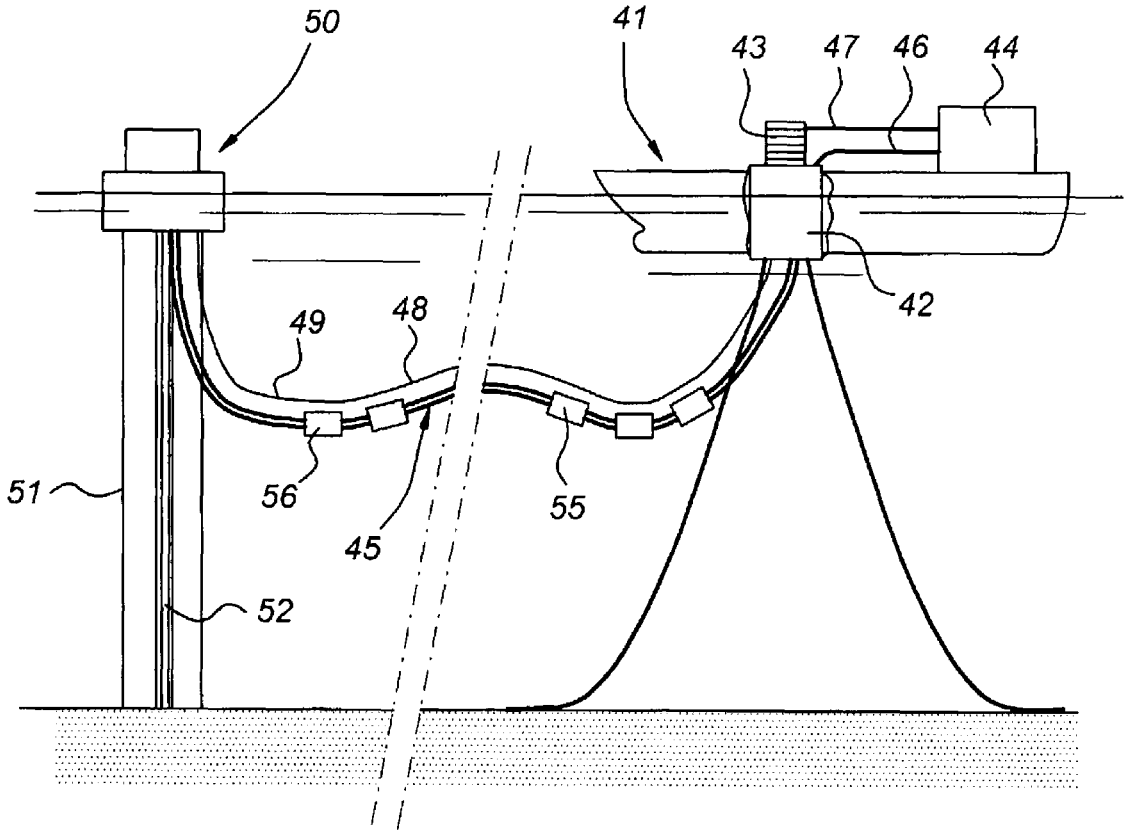
Figure 4:
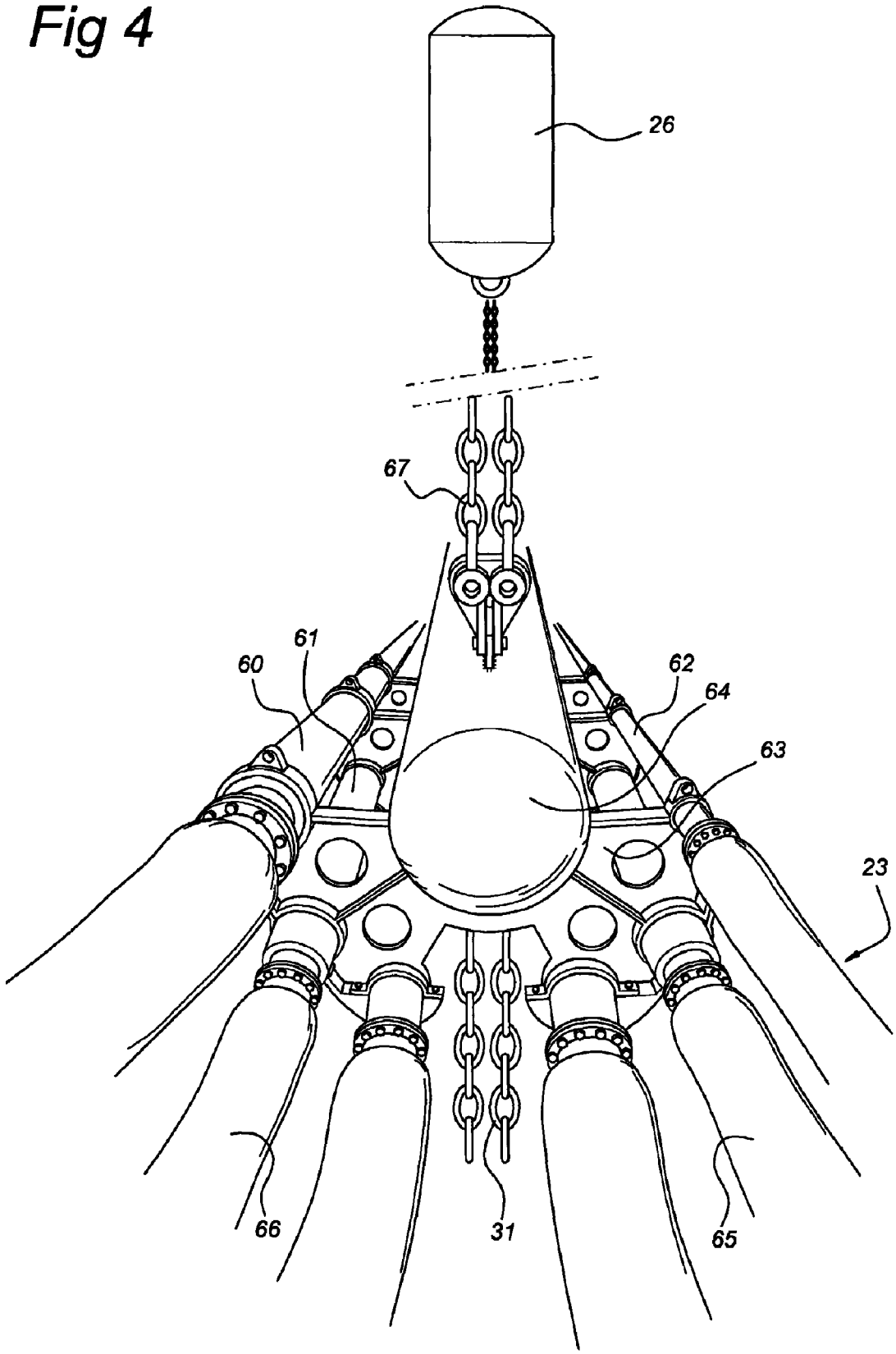
Figure 5:
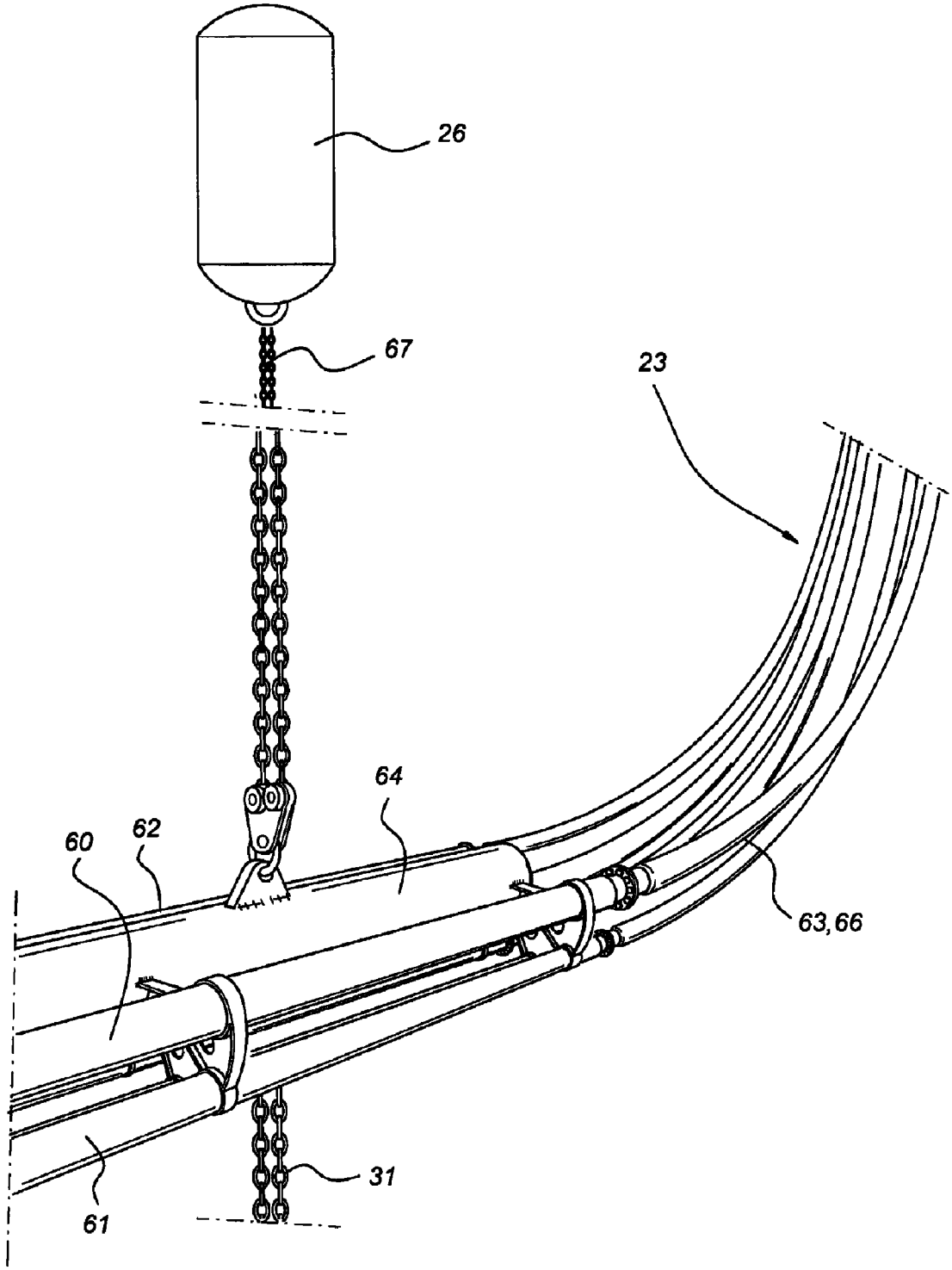

Some embodiments of a hydrocarbon exploration system will be explained, by way of non-limiting example, in detail with reference to the accompanying drawings. In the drawings:

FIG. 1 shows a perspective view of a hydrocarbon exploration and/or processing system according to the present invention, FIG. 2 shows a side view of the system of FIG. 1, FIG. 3 shows an embodiment of a system according to the present invention having a fluid transfer duct that extends along a curved path, FIGS. 4 and 5 show an end part of the fluid transfer duct and the power line bundle.

Figure 6A:
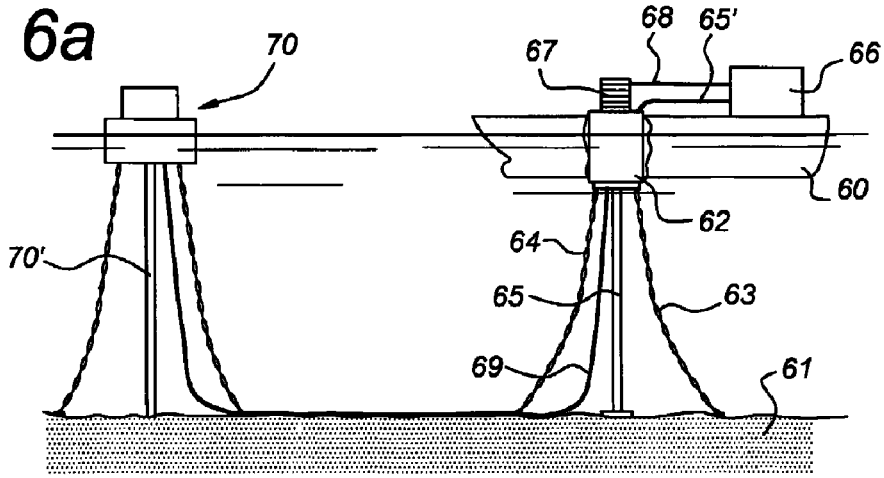
Figure 6B:
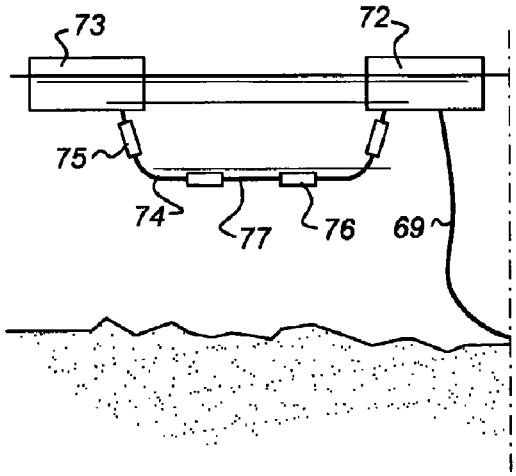
Figure 6C:
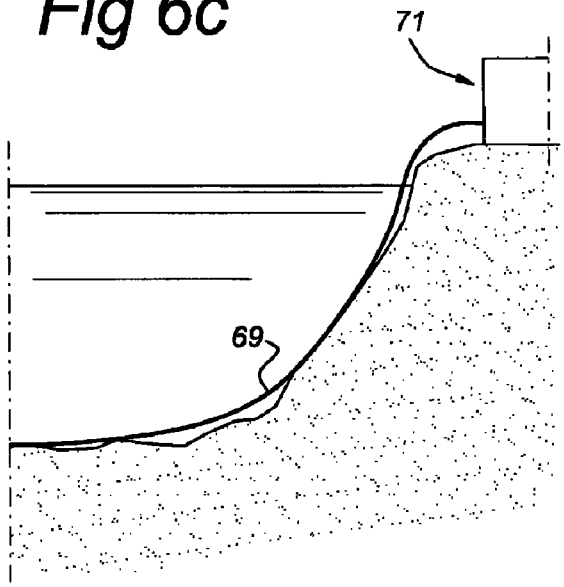
Figure 7:
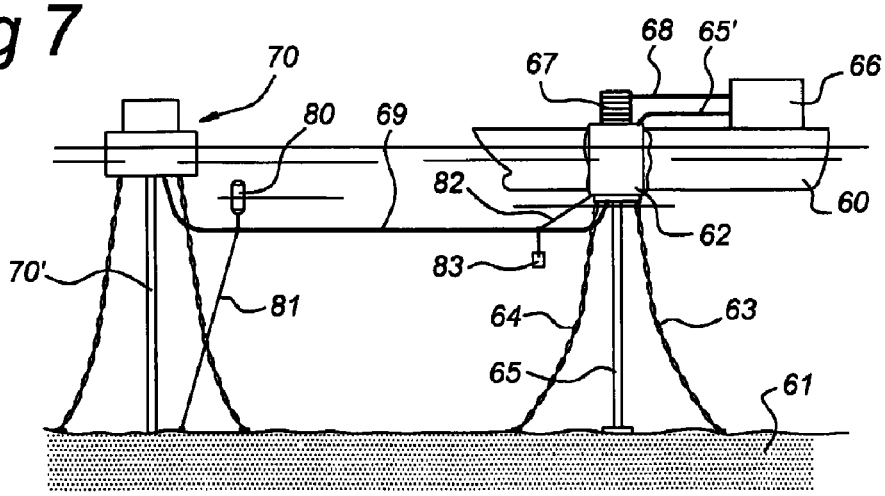

FIG. 6*a-c* show another embodiment of a hydrocarbon exploration and/or processing system, wherein a power generator is situated on an FPSO and connected to the second vessel via a high voltage swivel, the power supply cable being situated on the sea bed, and FIG. 7 shows an embodiment of a hydrocarbon exploration and/or processing system, wherein the fluid transfer duct and power cable are supported between the vessel in an axially tensioned manner.

FIG. 1 shows a perspective view of a hydrocarbon field, such as afield in water depths of over 1000 m. A central storage and/or processing vessel 1 is anchored to the sea bed 4 via anchor lines 2, which are connected to an external turret 3, around which the vessel can weathervane in accordance with prevailing environmental conditions. The vessel 1 can be an FPSO for storing and processing of oil, or may comprise a combination of oil and gas storage and processing facilities. The displacement of the vessel 1 may vary between 100,000 and 600,000 tons.

Located above hydrocarbon wells 5 and 6 are relatively small floating units 7, 8, anchored to the sea bed via taut tendons 9, 10. Product risers 12 are coupled to the subsea wells 5, 6 for carrying gas or oil upwards to the floating units 7, 8 and for transporting injection fluids such as gas or water downwards into the well. Control signals for operating valves on the well head may be provided via one or more umbillical risers.

The floating units 7,8 may comprise a dry tree unit with an upper structure 13 above water level, comprising terminations of the product risers 12, valves and manifolds. Alternatively, or in addition, the floating unit may comprise a dry completion unit, for attaching the risers to the well heads after completion of the drilling operation.

The floating units 7,8 comprise a base 15 below water level with a central part 16, and three radial arms 17, 18,19 projecting radially outwardly from the central part 16. The tendons 9, 10 are attached to the radial arms 17-19 whereas the product risers 12 are connected to the central part 16 of the floating units 7,8. The floating unit is a relatively small unit with a hull weight of between 2,000 and 15,000 ton. Via the manifolds and valves on the floating units 7,8, the product risers 12 are in fluid communication with a fluid transfer duct 20, 21 extending horizontally to the vessel 1 at a water depth of for instance between 30 and 300 m below water level, over a distance of between 500 m and several tens of kilometers. The transfer ducts 20, 21 are with end parts 22, 23 connected to the units 7,8 on the one side, and to the vessel 1 on the other side. The end part 22 of the fluid transfer duct 20, 21 can be connected to the outside of the central part 16 of the units 7,8 between two radial arms 17, 18, 19, separated from the risers connected to the seabed which are placed in the central part 16. The end parts 22, 23 of the transfer duct 20, 21 may comprise flexible jumper hoses, whereas a central section 24 of the fluid transfer duct may comprise rigid steel piping. At the end parts 22, 23, buoyancy elements 25, 26, 27, 28 are provided, exerting an upward force on the fluid transfer ducts 20, 21. Anchor lines 30, 31, 32, 33 extend from the end parts 22, 23 of each fluid transfer duct 20, 21 to the sea bed 4, in a V-shaped anchoring configuration such that the resulting force on the end parts 22, 23 is a radial tensioning force, preventing sagging and hogging of the fluid transfer ducts 20, 21. The buoyancy at the end parts of the fluid transfer ducts 20, 21 near the floating units 7,8 is such that the downward force exerted by the transfer duct is relatively low, preferably zero. Near the vessel 1, the buoyancy elements 26, 27 and anchor lines 31, 33 may be replaced by a counter weight system for tensioning of the transfer duct 20, 21, of the type as described in U.S. Pat. No. 6,394,154.

The vessel 1 may comprise a hydrocarbon processing facility 35, and a power generator 36 for generating electrical power by combustion of the processed hydrocarbons, which power is transferred via power cable 37 to an electrical swivel 38 and to a power cable 39, 40, supported on the fluid transfer ducts 20, 21. Via the power cables 39, 40, power is supplied to the floating units 7,8 for lighting, heating, and operation of valves and pumps and other equipment.

In FIG. 3, an alternative embodiment of an exploration mooring system is shown, in which a vessel 41 comprises a turret 42 within its hull, and an electrical and fluid swivel 43 on the turret 42. A hydrocarbon processing and power generating unit 44 is connected via the swivel 43 to the hydrocarbon transfer duct 45 for receiving hydrocarbons through duct 46, and for supplying electrical power via power cable 47 to the swivel 43. From the swivel 43, power is supplied through power supply line 49, supported on the fluid transfer duct 45, to the floating unit 50. The floating unit 50 is anchored to the sea bed via tendons 51, and is attached to a subsea hydrocarbon well via one or more risers 52. The fluid transfer duct 45 and the power supply line 49 extend along a curved path, such as a W-shaped path, supported by buoyancy members 55, 56 distributed along the length of the duct 45 to accommodate relative movements of the vessel 41 and the floating unit 50.

FIGS. 4 and 5 show an end part 23 of the hydrocarbon transfer duct 20. Rigid flow lines 60, 61 are supported on a frame 63, attached to a central buoyancy tank 64. Power supply line 62 is also supported on the frame 63. Flexible jumper hoses 65, 66 are bent upwardly to be connected to the vessel 1 and floating units 7,8. Via a chain 67, the buoyancy element 26 may be attached to the central buoyancy tank 64. In case sufficient buoyancy is provided by the central buoyancy tank 64, the separate buoyancy element 26 may be omitted. The central buoyancy tank 64 is connected to the seabed via the anchor line 31 which may at its upper part comprise a chain section, but which will for its main part be comprised of a synthetic anchor line.

FIG. 6*a*-6*c* show an offshore system comprising a Floating Production Storage and Offloading vessel (FPSO) 60 which is anchored to the sea bed 61 via a turret 62, at the bottom of which anchor lines 63 and 64 are attached. The vessel 60 can weathervane around the turret 62, which is geostationary. A product riser 65 extends from a sub sea hydrocarbon well to a product swivel (not shown) on the FPSO 60 and from the product swivel via duct 65' to production and/or processing equipment on the FPSO. In a power generation unit 66, gas produced from the well may be converted into electricity which is supplied to a swivel 67 according to the present invention. The power lead 68 extending from the power generation unit 66 is attached to conductors 60. The power lead 69, extending to the sea bed is connected to the electrical conductors of the outer annular wall of the swivel 67 which is fixedly attached to the turret 62. The power lead 69 may extend to an unmanned platform 70 attached to the sea bed via product riser 70', such as a gas riser, or may extend to an onshore power grid 71, or may be connected to heating elements 75, 76 of a substantially horizontal hydrocarbon transfer duct 77 between two floating structures 72, 73.

In the embodiment according to FIG. 7, a buoyancy element 80 is connected to the end part of the power supply cable/fluid transfer duct 69, a tensioning cable 81 extending at an angle to the vertical between the sea bed 61 and the second end part of cable/duct 69, for generating an axial tension. At the side of the vessel 60, a clump weight 83 is suspended from the first end part of the power supply cable/fluid transfer duct 69, and an inclined tensioning cable or chain 82 attaches the first end part to the vessel 60. It is also feasible to use the tensioning system of cable 81, and buoyancy element 80 on both ends of the cable/duct 69, or to use the combination of tensioning weight 83/cable 82 on both ends.

The invention claimed is:

1. Hydrocarbon exploration system, comprising:

a first vessel (1) having a turret (3) around which the vessel can weathervane, the turret being moored to the sea bed, and a second vessel (7, 8) connected with at least one riser (12) to a subsea well (5, 6), the first vessel being connected to the second vessel via a fluid transfer duct (20, 21) comprising a first end section (23) attached to the turret (3) of the first vessel (1), a substantially horizontal mid section (24), and a second end section (22) attached at or near the second vessel (7, 8), the fluid transfer duct extending at a depth between 30 m and 300 m below water level, and comprising a central buoyancy tank (64), a frame (63) attached to the tank carrying a number of flow lines (60,61) and a power supply cable (39,40), an anchor line (31) connecting the central buoyancy tank to the sea bed, wherein the second vessel (7, 8) has no large hydrocarbon storage facilities and a hull weight of between 2,000 and 15,000 tons and comprises an upper structure (13) and a submerged base (15) to which second vessel (7,8)) the riser (12) is connected, the base (15) being attached to the sea bed via taut tendons (9, 10), the weight exerted by the fluid transfer duct (20, 21) on the second vessel (7, 8) being below 1,000 ton, a power generator (35) being situated on the first vessel (1), wherein power is transferred from the power generator (35) via an electrical swivel (38) on the first vessel, to the power supply cable, the power supply cable (39, 40) extending along the flow lines (60, 61) from the first vessel (1) to the second vessel (7, 8), and being supported at least partly by the frame (63), and wherein at least one further said second vessel (7, 8), is attached to the first vessel (1) via a respective said fluid transfer duct (20,21).

2. Hydrocarbon exploration system according to claim 1, wherein the second vessel (7, 8) has a central part (16) and at least three transverse mooring arms (17, 18, 19), radially extending from the central part (16).

3. Hydrocarbon exploration system according to claim 1, further comprising an anchor line (30, 31, 32, 33) extending from the sea bed (4) to the second end section (22) of the horizontal mid section (24), at an angle to the vertical.

4. Hydrocarbon exploration system according to claim 1, wherein buoyancy elements (55, 56) are placed locally along the horizontal mid section of the transfer duct (45), the horizontal section extending along a curved trajectory.

5. Hydrocarbon exploration system according to claim 3, wherein a buoyancy member (26, 27) is attached to the first end section (23) of the fluid transfer duct (20, 21), a second anchor line (31, 33) being attached to the seabed (4) and the first end section (23) at an angle with the vertical.

6. Hydrocarbon exploration structure according to claim 2, the end part of the fluid transfer duct being attached to a vertical arm (17, 18, 19).

7. Hydrocarbon exploration system according to claim 2 further comprising an anchor line (30, 31, 32, 33) extending from the sea bed (4) to the second end section (22) of the horizontal mid section (24), at an angle to the vertical.

* * * * *